United States Patent [19]

Tolliver

[11] Patent Number: 4,598,523

[45] Date of Patent: Jul. 8, 1986

[54] REINFORCEMENT SUPPORT SPACER

[76] Inventor: Wilbur E. Tolliver, 364 Hamilton Dr., Holland, Mich. 49423

[21] Appl. No.: 571,567

[22] Filed: Jan. 17, 1984

[51] Int. Cl.[4] ..... E04C 5/16

[52] U.S. Cl. ..... 52/685; 52/687

[58] Field of Search ..... 52/679, 684, 685, 687, 52/688, 665; 256/47, 48, 32

[56] References Cited

U.S. PATENT DOCUMENTS

| | | | |
|---|---|---|---|
| 191,881 | 6/1877 | Plane | 256/48 |
| 467,434 | 1/1892 | Randall | 256/48 |
| 1,022,314 | 4/1912 | Golden | 256/48 |
| 1,362,707 | 12/1920 | Lampert | 52/684 |
| 1,409,645 | 3/1922 | Baker | 52/684 |
| 1,464,886 | 8/1923 | Snyder | 52/685 |
| 1,517,102 | 11/1924 | Bricker | 52/684 |
| 1,537,699 | 5/1925 | Rockwell | 52/681 |
| 1,613,351 | 1/1927 | Klinger et al. | 404/135 |
| 1,637,742 | 8/1927 | Edge et al. | 52/685 |
| 1,882,499 | 10/1932 | Johns | 52/454 |
| 2,132,220 | 10/1938 | Powers | 52/684 |
| 2,170,635 | 8/1939 | Emigholz | 72/122 |
| 2,412,744 | 12/1946 | Nelson | 72/16 |
| 3,105,423 | 10/1963 | Reiland | 52/677 |
| 3,360,898 | 1/1968 | Beckman | 52/684 |
| 3,512,330 | 5/1970 | Shlesinger | 52/677 |
| 3,693,310 | 9/1972 | Middleton | 52/685 |
| 4,063,397 | 12/1977 | Follows | 52/684 |
| 4,132,045 | 1/1979 | Sullivan | 52/685 |
| 4,270,583 | 6/1981 | Tolliver | 140/92.1 |
| 4,295,501 | 10/1981 | Tolliver | 140/92.1 |

FOREIGN PATENT DOCUMENTS

| | | | |
|---|---|---|---|
| 466689 | 7/1950 | Canada . | |
| 2109183 | 2/1971 | Fed. Rep. of Germany . | |
| 2157617 | 11/1971 | Fed. Rep. of Germany . | |
| 2118951 | 12/1970 | France . | |
| 2419372 | 11/1979 | France | 52/684 |
| 431000 | 1/1965 | Switzerland . | |

OTHER PUBLICATIONS

United States Steel publication, "CRCP . . . Transverse Steel and Reduced Labor Costs—You Can Have Both!" (no date).

Lewis Engineering Co. publication, "Clip Chair" (no date).

*Primary Examiner*—Henry E. Raduazo

*Attorney, Agent, or Firm*—Price, Heneveld, Huizenga & Cooper

[57] ABSTRACT

A reinforcement support spacer for spacedly positioning one or more concrete reinforcement members from a surface on which concrete is poured. The spacer comprises a support which has at least one recess therein for receiving a reinforcement member. Barbs or tines formed integrally with the support project into the recesses. The barbs or tines on each recess are oriented so as to permit a reinforcement member to be forced past the barbs or tines into the recess but substantially to prevent a reinforcement member from being forced past the barbs or tines out of the recess once a reinforcement member has been inserted into the recess. The support spacers of the present invention permit reinforcement members to be preassembled in spaced relationship to each other and installed as an assembly. The preassembled reinforcement assembly can be lifted onto the surface on which concrete is to be poured, saving on-site labor costs involved in assembling at the point of use.

17 Claims, 13 Drawing Figures

REINFORCEMENT SUPPORT SPACER

BACKGROUND OF THE INVENTION

The present invention relates to concrete reinforcements, and in particular, to a device for supporting and spacing such reinforcements and a reinforcement assembly using the device. Typically, concrete is reinforced by mats or layers of reinforcing bar and/or welded wire fabric. Each reinforcement layer or mat is suspended within the concrete structure. During pouring of the concrete, especially during pouring of horizontal slabs, it is necessary to suspend the reinforcing steel above the surface on which the concrete is poured. Often, a second layer or mat of reinforcement steel is spaced above the first reinforcement steel layer or mat in the concrete structure. Therefore, a supporting and spacing device is necessary to hold the reinforcement steel mats in their designated positions while the concrete is poured. The supporting and spacing device remains in the hardened concrete structure.

These devices are referred to herein as support spacers. Prior artisans often refer to them as "chairs".

A very common type of support spacer used to position such reinforcement steel mats is comprised of a small concrete block with a length of rebar protruding from the concrete, the rebar being bent into an L-shape at its free end. These support spacers are placed throughout the concrete structure, a first reinforcement steel mat being laid on the concrete blocks, and a second reinforcement steel mat being laid upon the L-shaped bent portion of the rebar member to hold the second reinforcement steel mat parallel to and a distance above the first.

One problem with the concrete block approach is that the top reinforcement steel mat can slide off of the L-shaped rebar member necessitating that the top reinforcement steel mat be tied to the L-shaped rebar member with a short piece of twisted wire. Having to tie the top reinforcement steel mat assembly to each support spacer in a large concrete structure requires considerable time and money in view of the high prevailing labor costs. Also, twisted wire has a tendency to break under load and the reinforcing members are free to move from their intended installed position.

Another problem with such concrete block spacers is that the lower reinforcement mat can slide off the concrete blocks while the concrete is being poured. Also, even though the top reinforcement mat is tied to the L-shaped rebar, the support spacer can be easily tipped over if the top reinforcement mat is located too close to the free end of the bent L-shaped rebar member. These conditions will cause the reinforcing members to be displaced from their installed and designated positions within the concrete structure. If the reinforcing steel layer or mat moves from its designated position, the cover concrete thickness above and below the reinforcing members is either increased or decreased. Recent studies have found that when the steel reinforcement is not positioned properly, deterioration of the concrete and reinforcement steel is greatly accelerated, especially in concrete roadways and parking structures where salt is applied in the wintertime.

Another critical problem with the concrete block spacer is that concrete blocks produce a non-uniform concrete structure. This can lead to stress discontinuities between the block and the poured concrete.

Another example of such a spacer is disclosed in Malsbur U.S. Pat. No. 2,754,764 entitled "REINFORCED CONCRETE BEAM SUPPORT" which shows a rebar with a U-shape bent free end, allowing two wire assemblies to be tied onto the bent area and a third assembly to be layered on a concrete base. Another type of spacer is disclosed in U.S. Pat. No. 1,772,741 entitled "REINFORCING STIRRUP ASSEMBLY" issued to Barber which comprises an inverted V-saddle on which a reinforcing assembly rests.

An inverted "V" spacer with a rebar rod support clip welded to its top is disclosed in U.S. Pat. No. 3,114,221 issued to Eriksson entitled "BROAD-SUPPORTING CHAIR FOR CONTINUOUSLY REINFORCING CONCRETE PAVING." By bending the tabs on the clip, one locks the rebar in place. However, the clip can break off the support and seems particularly susceptible to such breakage when the clip is bent by foot as shown in the patent. Also, such an assembly is expensive to manufacture.

SUMMARY OF THE INVENTION

The present invention is a reinforcement support spacer for use in supporting and spacing reinforcement members for concrete structures which comprises a support having at least one recess therein for receiving a reinforcement member and locking means integrally formed in the support for positively locking a reinforcement member into the recess.

In narrower aspects of the invention, the reinforcement support spacer locking means comprise barbs or tangs disposed within the recess to permit a reinforcing member to be slidably inserted within the recess but to prevent the reinforcing member from being pulled from the recess after being inserted.

The reinforcing support spacer of the present invention positively locks concrete reinforcing members thereby preventing the reinforcing members from floating or from being forced out of their installed position in plastic concrete. The spacer of the present invention also prevents significant movement of the reinforcement members before, during and after pouring of the concrete. Additionally, the reinforcement support spacer of the present invention can economically be manufactured from plastic or steel.

Finally, when a plurality of reinforcement support spacers of the present invention are used, one or more reinforcement layers can be preassembled and positively interlocked to form a reinforcing system, and can be picked up and installed as a single unit.

These and other advantages and features of the present invention will be more fully understood and appreciated by reference to the written specification and appended drawings.

DETAILED DESCRIPTION OF THE PREFERRED EMBODIMENT

Figure 1:
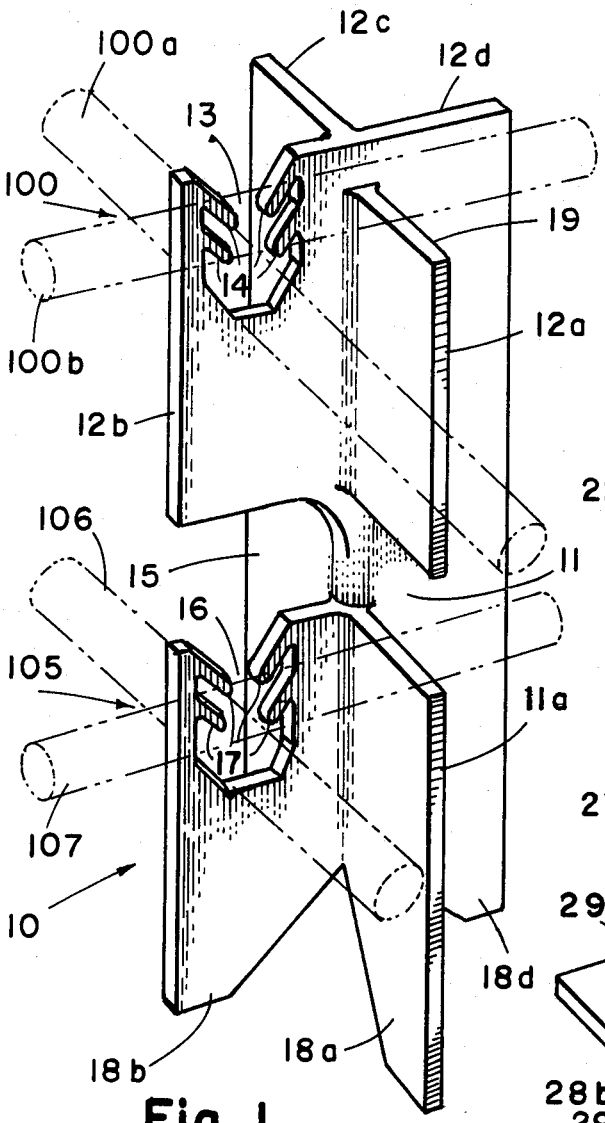
FIG. 1 is a perspective view of a preferred embodiment of the present invention made from plastic and having recesses with barbs therein for positively locking two reinforcing mats in spaced relationship to each other and to a surface.

In a preferred embodiment, support spacer 10 is a two-tier, two-recess reinforcement support spacer (FIG. 1) having webs 12*a, b, c* and *d*, upper recess 13, lower recess 16 and feet 18. Upper recess 13 has opposed barbs 14 disposed therein to permit a reinforcement member such as reinforcement member 100 to be forceably inserted between barbs 14 and into recess 13 but substantially to prevent reinforcement member 100 from being pulled from recess 13. Lower recess 16 has opposed barbs 17 disposed therein to permit a reinforcement member 105 to be forceably inserted between barbs 17 and into recess 16 but substantially to prevent reinforcement member 105 from being pulled from recess 16. Reinforcement support spacer 10 and the reinforcement members 100 and 105 are supported on a horizontal surface by feet 18*a, b, c* (not shown) and *d* resting firmly on the horizontal surface.

So that reinforcement support spacer 10 can be attached to a mat 100 near the intersection of perpendicular mat members 101 and 102, web 12*a* is provided with a shoulder 19 which is below the top of column 11. Web 12*a* is cut away at 11 to permit support spacer 10 to be attached to a lower reinforcement mat 105 at the intersection of perpendicular mat members 106 and 107. To permit a bottom reinforcement member to be inserted into lower recess 16, a portion of web 12*b* is cut away at 15.

Figure 7:
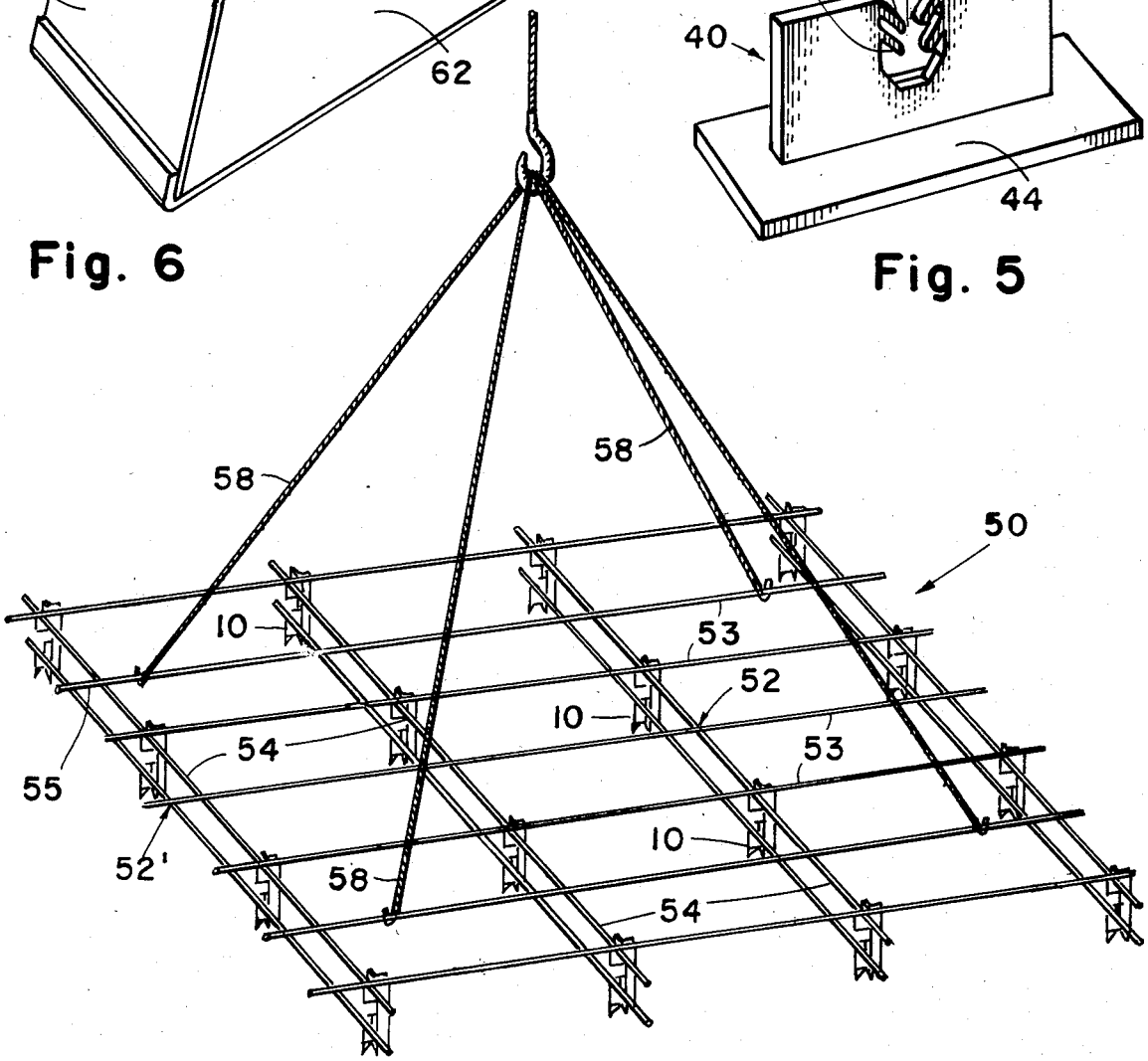
FIG. 7 is a perspective view of a preassembled mat assembly with spacers of the present invention.

The term "reinforcement" is used to mean steel reinforcement typically used to reinforce concrete. There are two general types: reinforcement bars and welded wire fabric reinforcement. Two reinforcement mats 52, 52' are shown in FIG. 7 as comprising members (53) and members (54) perpendicular thereto (using the upper mat for illustration purposes) as part of a lattice. The term reinforcement mat refers to a reinforcement grid made up of a plurality of reinforcement members in two sets, at right angles to each other. In the case of reinforcement bar (rebar) mats, the rebar members are most commonly tied with wire at their intersections with each other. In the case of welded wire fabric reinforcement mats, the members are welded at their intersections. A reinforcement mat 100 is partially shown in FIG. 1 as including member 100*a* and member 100*b* perpendicular to each other. It should be understood that steel bars or welded wire fabric can be used in combination with the spacer of the present invention.

Spacer 10 is molded from plastic. Webs 12*a–d* radiate outwardly from a central vertical axis. Each is also relatively stiff to provide support for upper and lower reinforcement 100 and 105 before, during and after pouring of the concrete. Each web 12*a–d* terminates in feet 18*a–d*, respectively. Feet 18*a–d* engage the form surface upon which spacer 10 is placed.

Unlike webs 12, *c*, and *d*, web 12*b* is discontinuous in two respects. First, it includes a top recess 13 located at its top edge, and an intermediate recess 16 located intermediate the top and bottom of web 12*b*. Second, a portion of web 12*b* is cut away at 15. This allows recess 16 to open upwardly rather than to the side, and allows one to insert a reinforcement member into gap 15 and then downwardly into upward opening recess 16.

Both recesses 13 and 16 open upwardly. This allows one to force reinforcement downwardly into the recesses, using the resistance of the surface upon which spacer 10 rests to facilitate applying the downward force. If recesses 13 and 16 opened to the side, one would have to oppose the insertion of reinforcement into the openings by placing a hand or foot against the opposite side of spacer 10. Otherwise the spacer would just move in response to the insertion force.

Each recess 13, 16 is provided with barbs 14 and 17 respectively. FIG. 2 shows a detailed view of the barbed recess 13 of FIG. 1. This arrangement comprises upper opposed barbs 14*a*, lower opposed barbs 14*b* and a bottom portion 33. Opposed barbs 14*a* and 14*b* are each oriented inwardly toward the longitudinal axis of recess 13 and are angled toward the bottom 33 of the recess at approximately a 30 degree angle to a line normal to the longitudinal axis. Barbs 14 are oriented generally inwardly and toward the bottom of recess 13 to permit a reinforcement member to be forced therebetween to the base 33 of recess 13 and to prevent the reinforcement member from being pulled from recess 13 without the application of a great force. FIG. 2*a* shows a detailed view of the barb-recess 13 of FIG. 1 having a reinforcement member 100*a* inserted into the recess. It can be seen that lower opposed barbs 14*b* engage reinforcement member 100*a* and are forced outwardly by reinforcement member 100*a*. Barbs 14*b*, therefore, hold or grip the reinforcement member in recess 13. Barbs 14*a* primarily lock the reinforcement member in the recess, but barbs 14*b* tend to lock and hold as well.

As indicated above, support spacer 10 is made from plastic. While webs 12*a–d* must have a certain stiffness, barbs 14, 17 must have flexibility. Hence, the plastic material of spacer 10 should be sufficiently flexible such that a reinforcement member can be forced past the barbs into the recess, but the plastic should be sufficiently rigid so as to prevent substantially a reinforcement member from being pulled outwardly from the recess due to the upward force of the concrete as it is being poured. Also, the plastic must have sufficient rigidity that webs 12*a–d* are stiff and resist bending under the weight of the reinforcement steel, workers, equipment and pouring concrete. It has been found that high density polypropylene is a suitable plastic to use. High density polyethylene is also acceptable.

The base 33 of recess 13 has horizontal dimensions at least equal to the radius of the largest reinforcing member to be inserted in recess 13. The construction of recess 16 and barbs 17 is comparable to that of recess 13 and barbs 14. The dimensions may differ if recess 16 is intended to accommodate a different sized reinforcement member.

Because recess 13 must be sufficiently deep to accommodate reinforcement member 100*a* as well as barbs 14 located above member 100*a*, the top of spacer 10 must of necessity extend higher than rod 100*a* resting in recess 13. If it did not, there would be no upper support for the upper portion of web 12*b*. To make it possible to locate spacer 10 adjacent a transverse reinforcement bar or rod 100*b*, web 12*a*, which is spaced 90 degrees from web 12*b*, is terminated short of the top the spacer. The top of web 12*a* defines a shoulder 19 spaced below transverse rod 100*b*. Shoulder 19 should be of sufficient depth from the top of spacer 10 such that the top of spacer 10 is no higher than the uppermost portions of reinforcement rod 100*b*. This ensures that the cover concrete above the reinforcement steel will be of substantially uniform thickness from the top of the reinforcement assembly (i.e., the reinforcement mat and spacers) to the surface of the concrete.

Web 12*a* is cut away at 11, defining shoulder 11*a*, so that it is possible to locate spacer 10 adjacent a transverse reinforcement member 107, web 12*a* being spaced 90 degrees from web 12*b*.

In use, a first reinforcement mat 105 is laid onto a surface onto which concrete is to be poured. At various points along the first reinforcement mat lattice, reinforcement spacers 10 are lockably secured by lifting the first reinforcement member into cut away portion 15 and pushing reinforcement member 106 into lower recess 16 past barbs 17. A second reinforcement mat 100 is lifted to the top of reinforcement spacer 10 and positioned at the opening of each recess 13. Reinforcement member 100*a* is then forced downwardly past barbs 14 into each recess 13 in each spacer. In this manner, the two assemblies will be spaced from each other and from the surface on to which concrete is to be poured. Barbs 14 and 17 will lock first reinforcement assembly and second reinforcement assembly into recesses 13 and 16, respectively, due to the directional orientation of the barbs into their respective recesses.

The support spacers are spaced from each other at a distance both longitudinally and transversely as required to support the steel reinforcement, the anticipated amount of concrete to be poured onto the mat, and the anticipated loads during construction (workers, equipment and the like) or on the mats. Typically, the support spacers are spaced four feet on center in other direction.

Figure 3:
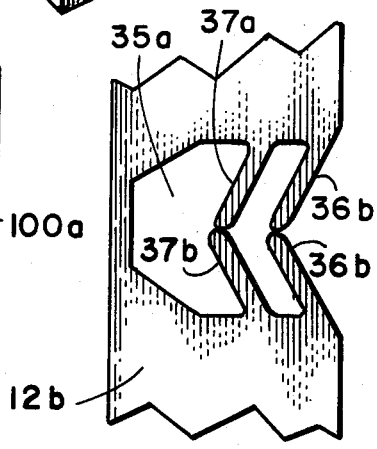
FIG. 3 is a detail showing alternate dimensions for the barbs and recesses of the embodiments of FIGS. 1, 4 and 5.

An alternative recess arrangement is illustrated in FIG. 3. Web 12*b* includes a side opening recess 35*a* having upper barbs 36*a* and *b* and lower barbs 37*a* and *b*, each pair of barbs meeting at the longitudinal axis of recess 35. Note that the barbs touch but are not joined at the longitudinal axis. The recess of FIG. 3 is particularly adapted for reinforcement members having very small diameters. Barbs 36*a* and *b* and barbs 37*a* and *b* can be manufactured to meet at the longitudinal axis if extra force is deemed necessary to retain a reinforcement member within recess 35. While recess 35*a* is a side opening recess, the principle of barbs which meet at their ends could also be used in an upwardly opening recess.

An alternative embodiment of the two-tier, two-recess reinforcement support spacer described above is shown in FIG. 4. The reinforcement support spacer 20 shown in FIG. 4 comprises a column 21, webs 22*a, b, c* and *d*, upper recess 23, lower recess 26 and feet 28. Upper recess 23 has barbs 24, and lower recess 26 has barbs 27. Upper recess 23 and lower recess 26 are oriented so that their longitudinal axes are perpendicular to the longitudinal axis of reinforcement spacer 20. The reinforcement members are forced sideways into recesses 23 and 26. Notch 27*a* is provided to allow support spacer 20 to be positioned at the intersection of two perpendicular bars or rods on a lower reinforcement member. Shoulder 25 is provided to permit spacer 20 to be positioned at the intersection of two perpendicular bars or rods on an upper reinforcement member.

Figure 4:
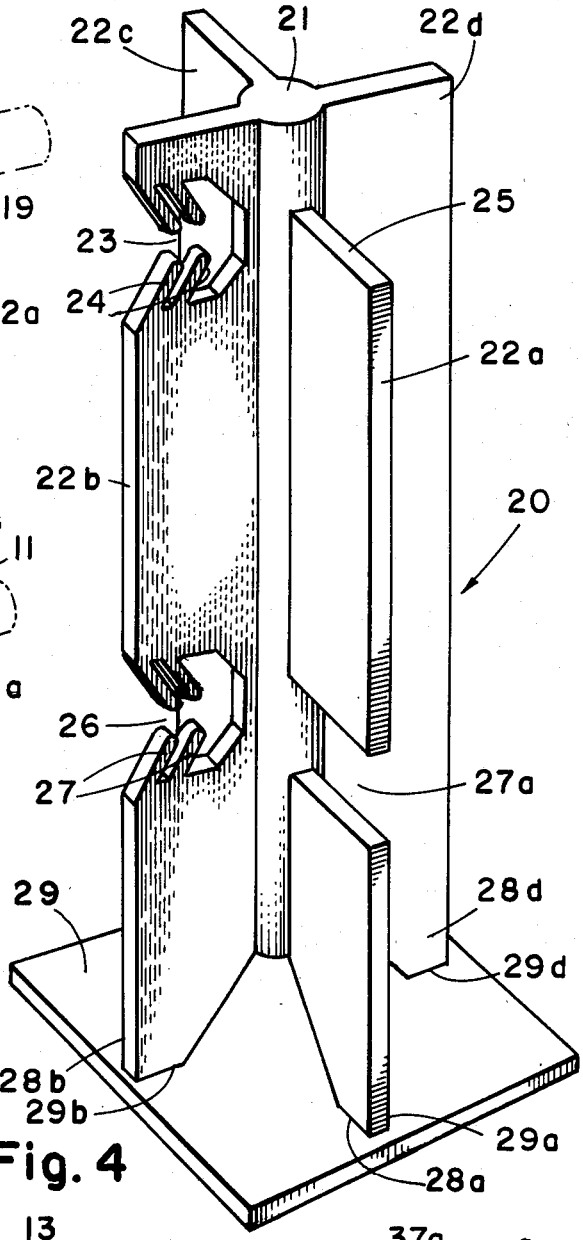
FIG. 4 is a perspective view of a modification of the embodiment shown in FIG. 1 having side opening recesses and a base for on-grade use.

One advantage to the side opening two-tier, two-recess reinforcement spacer shown in FIG. 4 is that notch 27*a* can be made smaller than the corresponding notch 11 on reinforcement spacer 10. Notch 11 must be made larger to allow the vertical movement of reinforcement mat member 105 as it is being inserted into cutaway portion 15 and pushed downwardly into recess 16. By contrast, the reinforcement member inserted into recess 26 need only be moved horizontally. Therefore, notch 27*a* is smaller. Because notch 27*a* is smaller, web 22*a* is stronger than web 12*a*.

The addition of column 21 to alternative embodiment 20 gives spacer 20 additional strength and stiffness vis-a-vis spacer 10. Where heavier reinforcement is used, or where heavier loads on the reinforcement are anticipated, the additional strength offered by column 21 might be desirable.

Also shown in FIG. 4 is a base 29 on which feet 28 rest and to which they are secured. Base 29 is provided with slots 29*a, c, d* into which feet 28*a, b, c* and *d* are inserted in a snap-fit engagement. A base 29 should be used when it is desired to use the two-level reinforcement spacer of the present invention on-grade. In other words, when pouring concrete on-grade as opposed to above grade where flat horizontal forms are used, a base 29 should be added to distribute the weight carried by feet 28 over a wider area. Base 29 should not be considered as applicable only to a spacer having side-opening recesses shown in FIG. 4. In any event, it is easy to convert the support spacer from an above grade to a on-grade support spacer merely by snapping on or removing base 29 as described above.

Base 29 also has another advantage. The concrete being poured will weigh down upon base 29. This weight will oppose the upward force exerted by the rising concrete against reinforcement members and prevent the reinforcement members from floating in the concrete.

Base 29 could be integrally molded with webs 28*a–d* and central column 21. In that case, said webs and column would extend all the way to base 29, eliminating any opening between the bottom and of column 21 and base 29.

Spacer 20 as shown thus has several features differing from those of spacer 10. The showing of same in one spacer, i.e., 20, is not intended to imply that they must of necessity be used in conjunction. They could be used independently of one another in various alternatives to spacers 10 and 20 as shown.

Figure 4A:
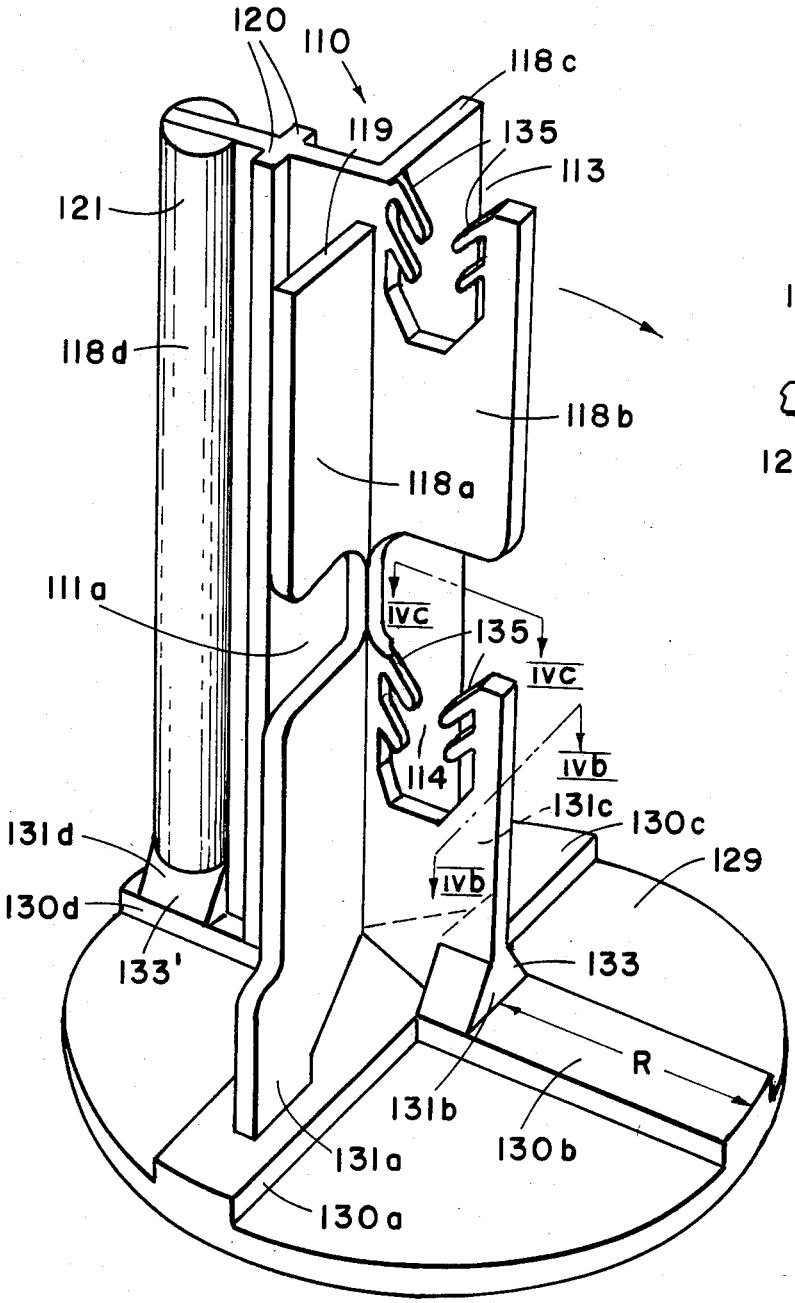
FIG. 4*a* is a perspective view of a second modification of the embodiment shown in FIG. 1 having a reinforced web opposite the web having the recesses.

A third embodiment of the present invention, a two-tier reinforcement support spacer 110 is shown in FIG. 4*a*. It comprises barbed recesses 113 and 114 on a web 118*b*. A shoulder 119 and a notch 111*a* are provided on a web 118*a* to accommodate transverse reinforcement members on reinforcement mats having members inserted into recesses 113 and 114, respectively. These features are substantially identical to the corresponding features of the embodiment shown in FIG. 1.

Figure 2:
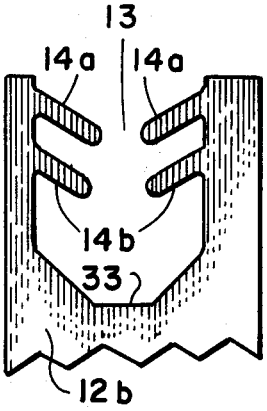
FIG. 2 is a detail showing the dimensions of the barbs and recesses of the embodiments of FIGS. 1, 4 and 5.
Figure 2A:
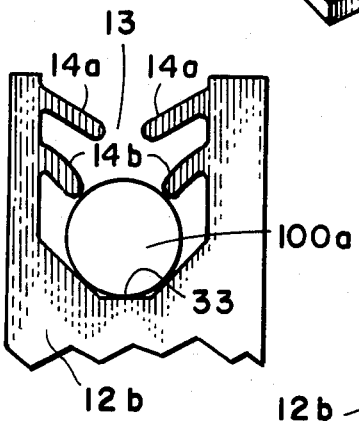
FIG. 2*a* is the same view as FIG. 2, but with a reinforcement member shown in position within the recess.

The embodiment shown in FIG. 4*a* is specifically designed for heavier loading than the embodiment of FIG. 1. To accommodate heavier loads, web 118*d* is provided with reinforcement ribs 120 and a large reinforcement bead 121. Reinforcement ribs 120 are projections integrally formed in web 118*d*, extending along the longitudinal length of web 118*d*, and located between the juncture of the four webs 118 and bead 121. In most applications, ribs 120 and bead 121 are probably not necessary in conjunction, but rather will typically be alternatives. Bead 121 is cylindrically shaped and extends along the longitudinal length of web 118*d* at the outer edge thereof. Bead 121 is also integrally formed with web 118*d*.

It has been found that for particularly large loads, for instance, many construction workers standing on the upper reinforcement mat, the support spacer made from plastic will have a tendency to bend about the center at or slightly above the lower recess 114 in the general direction of the arrow shown in FIG. 4*a* stretching web 118*d*. This bending movement can be resisted by thickening web 118*d* either with the reinforcement ribs 120 or the reinforcement bead 121, or both. It should be evident that thickening web 118*d* longitudinally with reinforcement ribs 120, reinforcement bead 121 or some other thickening structure will increase the force necessary to stretch web 118*d* when the moment exerted on recess 113 is applied. Reinforcement ribs 120 and reinforcement bead 121, of course, are merely illustrative of the types of strengthening means which can be employed.

Base 129 is circular and has been modified to increase the resistance of the support spacer 110 to tipping over from the moment applied in recesses 113, 114. As shown, support spacer 110 can be eccentrically mounted on base 129 so that web 118*b* is directly over the center of base 129. Thus, there is a distance R from the center of the base 129 to the edge thereof which acts as a lever arm to resist tipping of the support spacer 110, the support spacer 110 being fixedly secured to base 129 in a manner to be described.

Base 129 also includes thickening ribs 130*a–d*. Each of the thickening ribs extends radially outwardly from each of the feet 131*a–d* of reinforcement support spacer 110. Thickening ribs 130*a–d* join at a common center offset from the center of base plate 129 to form a cross-shaped pattern on base plate 129. Thickening ribs 130*a–d* are integrally formed with base plate 129. Thickening ribs 130 are provided to reinforce the base plate 129 where it is necessary. This represents a savings of material from having to have a uniformly thick base plate 129. A uniformly thick base plate would involve reinforcing portions of base 129 which do not need to be reinforced.

Figure 4B:
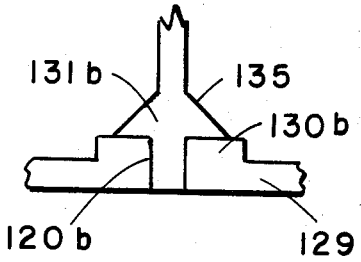
FIG. 4*b* is a detail sectional view taken along the plane of line IVB—IVB of FIG. 4*a*.

Base plate 129 can be integrally formed with reinforcement support spacer in the same injection mold. Alternatively, it is possible to have reinforcement support space 110 engage base plate 129 in a snap-fit relationship as shown in FIG. 4*b*. Each of the feet 131 can, therefore, be provided with projections which engage holes in thickening ribs 130.

Several other modifications can be made to the embodiment of FIG. 1 as shown in FIG. 4*a*. First of all, feet 131*b* and *d* can be flared outwardly and downwardly, as indicated at 133 and 133'. If base plate 129 is snapped onto reinforcement support spacer 110, having flares 133, 133'prevents feet 131 from penetrating too far into base plate 129. As shown in FIG. 4*b*, for instance, if flare 133 is wider than hole 129*b* into which foot 131*b* is inserted, foot 131*b* cannot penetrate downwardly past flares 133 into base plate 129.

Figure 4C:
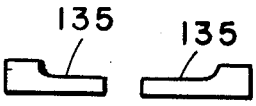
FIG. 4*c* is a detail top plan view of two of the barbs in the recesses of the embodiment shown in FIG. 4*a*.

Additionally, reinforcement support spacer 110 has webs 118*a* and *c* which are thinner than, and which project a shorter distance outwardly from the longitudinal axis of the reinforcement support spacer, than webs 118*b* and 118*d*. This represents a savings of material over the embodiment shown in FIG. 1. Finally, as shown in FIG. 4*c*, each of the barbs in recesses 113, 114 can be narrowed as shown to provide more resiliency if desired. When narrowing the barbs 135 as shown, it is desirable to take away the material from only one side of web 118*b*. If the reinforcement support spacer 110 is injection molded with the parting line of the molds being parallel to and across webs 118*b* and 118*d*, narrowing barbs 135, as shown in FIG. 4*c*, means that only one of the two mold halves need to be machined to provide cavities for barbs 135.

The embodiments of FIGS. 1, 4 and 4*a* can conveniently be injection molded. In fact, a mold can be constructed for manufacturing a reinforcement spacer having more than two recesses. Mold inserts can be inserted into the mold so that a two or even a one-recess reinforcement spacer can be manufactured from the same mold.

Figure 5:
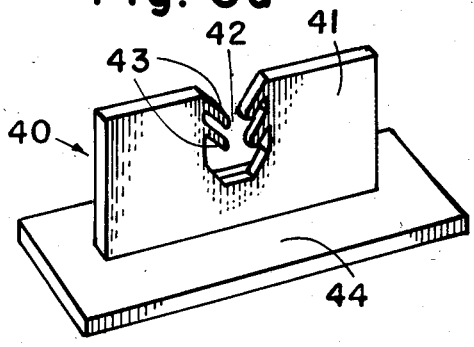
FIG. 5 is a perspective view of another embodiment of the present invention for positively locking a single reinforcement member in spaced relationship to a surface.

A fourth embodiment of the present invention, a single tier reinforcement support spacer 40 is shown in FIG. 5. Reinforcement spacer 40 comprises a web 41 having a recess 42 therein, recess 42 having barbs 43 for lockably gripping a reinforcement member which can be forced downwardly past barbs 43 into the bottom of recess 42. Web 41 is fixedly secured to and perpendicular with a base 44 which rests upon a surface onto which concrete is to be poured. The embodiment of FIG. 5 is used for spacing a single reinforcement assembly above a surface in contrast with the embodiments illustrated in FIGS. 1 and 4 which space two reinforcement assemblies above a surface. The embodiment of FIG. 5 is particularly well suited for on-grade applications because base 44 provides a large surface area onto which web 41 and the reinforcement assembly inserted into recess 42 can rest. In other words, the weight of the reinforcement assembly is distributed over the entire area of base 44. Base 44 also acts to prevent the upward movement of the reinforcement member when concrete is poured because the concrete as it is poured will weigh down the top surface of base 44.

Recess 42 and barbs 43 of reinforcement spacer 40 can have the proportional dimensions of either of the recesses illustrated in FIGS. 2 and 3. As indicated above, the length of barbs 43 and the diameter of the rounded portion of the bottom of recess 42 is dependent upon the diameter of the reinforcement member to be forceably inserted into recess 42.

Figure 6:
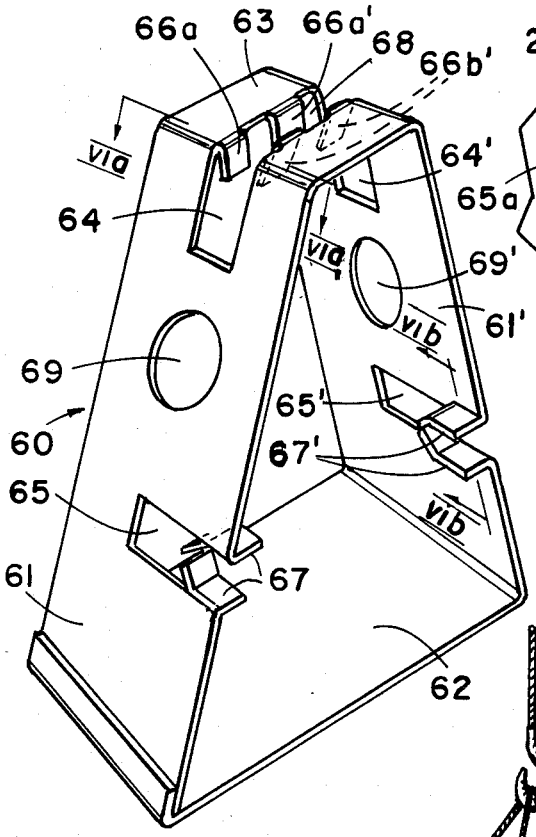
FIG. 6 is a perspective view of an alternative embodiment of the present invention made from sheet metal and having recesses with tines therein for positively locking two reinforcing mats in spaced relationship to each other and to a surface.

As shown in FIG. 6, the reinforcement support spacer of the present invention can also be made from sheet metal. FIG. 6 illustrates a support spacer 60 having sidewalls 61, 61', a bottom wall 62 and a top wall 63 intermediate the tops of sidewalls 61, 61'. Recesses 65, 65' are provided for lockably receiving a lower reinforcement member. At the tops of sidewalls 61, 61', recesses 64, 64' are provided for lockably receiving a top reinforcement member. A gap 68 is provided across the top wall 63 to permit the upper reinforcement member to be inserted into recesses 64, 64' through the top of support spacer 60.

Figure 6B:
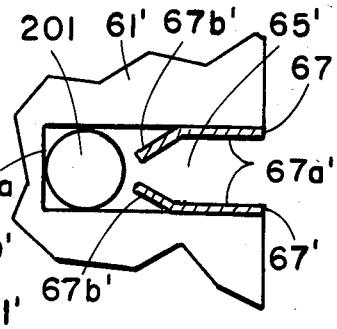
FIG. 6*b* is a detail partial cross-sectional view of the lower recess and tines taken along the line 6*b*—6*b* in FIG. 6.
Figure 6A:
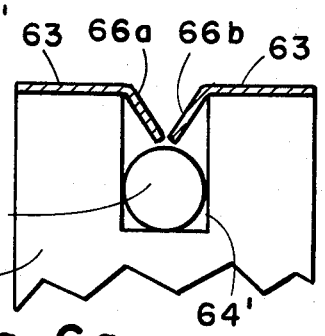
FIG. 6*a* is a detail partial cross-sectional view of the upper recess and tines taken along the line 6*a*—6*a* in FIG. 6.

Locking tines 66, 66' depend downwardly from top wall 63 as shown in FIG. 6 to lock an upper reinforcement member into recesses 64, 64'. As shown in detail in FIG. 6*a*, locking tines 66 comprise a pair of locking tines 66*a* and 66*b*. It should be understood that even though locking tines 66 are illustrated in FIG. 6*a*, locking tines 66' are identical therewith so reference will be made only to locking tines 66. Note that the tines on one side of gap 68 are staggered from the tines on the other side of gap 68. This is done because the tines are stamped out of the top wall forming gap 68. In order to make the tines as long as possible, they must be staggered as their maximum length is equal to the width of gap 68.

Locking tines 66 are each oriented inwardly toward the longitudinal axis of recesses 64, 64' and are angled toward the bottom of the recesses. Locking tines 66*a*, 66*b* must have flexibility such that after a reinforcement member is forced past the locking tines into the recess as shown in FIG. 6*a*, the tines will substantially return to their original positions thereby locking a reinforcement member 200 into recesses 64, 64'.

The configuration of locking tines 67, 67' for bottom recesses 65, 65' is somewhat different from the configuration of tines 66, 66'. However, they function the same way. Locking tines 67, 67' are identical to each other; locking tines 67' are illustrated in FIG. 6*b*. Each locking tine 67' includes a horizontal tine support 67*a'* which is formed integrally with sidewall 61' and projects inwardly into the spacer as shown in FIG. 6 along upper and lower horizontal edges of recess 65'. Extending inwardly toward the longitudinal axis of recess 65' from tine supports 67*a'* are opposed locking tines 67*b'*. Tines 67*b'* are angled toward a bottom 65*a'* of recess 65'.

Locking tines 67*b'* are sufficiently resilient such that after a reinforcement member 201 is forced past the locking tines, the locking tines will return substantially to their original positions thereby locking reinforcement member 201 into recess 65' as shown in FIG. 6*b*.

Reinforcement support spacer 60 is easily manufactured by stamping recesses 64, 64' and a slot constituting a gap 68, recesses 65, 65' in a strip of metal, tines 66, 66' and tines 67, 67' being stamped in the same process. The strip of metal is then bent in a trapezoidal shape in a conventional stamping process with a fold 68 being formed integrally with the bottom wall 62 and engaging the bottom portion of sidewall 61 thereby preventing the bottom of the sidewalls 61, 61' from spreading apart. No welding is required to secure fold 68 to the bottom of sidewall 31, though it could be advantageously utilized as an added securement, if desired. Fold 68 acts as a hook which prevents sidewalls 31, 31' from separating under the weight of the reinforcement mat members inserted into recesses 64, 64' and 65, 65'.

Lightening holes 69, 69' can be stamped into sidewalls 61, 61' to permit concrete to flow therethrough. When the concrete solidifies in the holes, it forms a bridge of concrete between the concrete inside the spacer and the concrete outside the spacer thereby strenthening the concrete structure by arresting shear stresses which may develop along the planes of walls 61, 61'. Any shear stress developed along these walls would by necessity have to fracture the concrete bridges formed in lightening holes 69, 69'.

One of ordinary skill in the art will recognize that the embodiment shown in FIG. 6 is an adaptation of the spacer disclosed in my co-pending patent application Ser. No. 571,566 filed Jan. 26, 1983, entitled REINFORCEMENT SUPPORT SPACER. That application is expressly incorporated herein by reference.

One advantage in the reinforcement support spacer of the present invention is that a reinforcement assembly can be preassembled at a factory or on the construction site. Depending upon the transportation costs, preassembly at the factory can result in significant labor cost savings considering the rather high prevailing wages of on-site construction workers.

Such preassembly can be done with a single-level spacer illustrated in FIG. 5. If a reinforcement mat is used, for instance, a plurality of reinforcement spacers 40 can be secured to the mat at various points on the mat in the factory so that when the mat is shipped to the construction site, the mat can be lowered onto the surface onto which concrete is poured with the reinforcement spacers 40 preattached. Care should be taken in ensuring that the bases 44 of reinforcement spacers 40 are oriented toward said surface before concrete is poured.

Preassembly of the reinforcement assembly is particularly advantageous when the two-tier spacer of FIGS. 1, 4 or 6 is used. As indicated in FIG. 7, a reinforcement mat assembly 50 preassembled at a factory or on the job site comprises an upper mat 52 and a lower mat 55 lockably and spacedly secured to each other by spacers 10. Spacers 10, of course, can have the features of the spacers illustrated in FIGS. 1, 4 or 6, though spacer 10 of FIG. 1 is specifically shown. The advantage to preassembling reinforcement mat assembly 50 at a factory is that the mat assembly can be picked up by a crane (not shown) by hooks 58 secured to lower mat 55 or upper mat 52. By hooking on the lower mat 55, one of the cross wires or length of rebar will be lifted against the upper edge of recess 111*a*, to thereby prevent either the upper mat 52 or lower mat 55 from being pulled out of engagement with their retaining barbs 135. In this manner, the entire assembly can be lowered onto the surface onto which the concrete is to be poured with the mats and spacers oriented in the proper directions.

The reinforcement spacer of FIG. 6 is also well adapted to preassembly of reinforcement mats. A plurality of reinforcement support spacers 60 can be lockably secured to a lower reinforcement mat by locking the reinforcement support spacer to a member of the lower reinforcement mat by insertion of that member into the corresponding lower recesses on each spacer past the locking tines therein. An upper reinforcement mat can be placed over the first by inserting an upper reinforcement mat member into the corresponding upper recesses on the reinforcement support spacers. The second reinforcement mat will be locked to the spacer by the locking tines in the upper recesses. By "corresponding recesses " it is meant that each reinforcement set is inserted into recesses spaced vertically from one another on each of the support spacers such that each reinforcement set is spaced from and generally parallel to other reinforcement sets.

It should be apparent that the present invention is also not restricted to a one or two-level spacer. It is possible, consistent with the teachings of the present invention, to construct a spacer having more than two tiers or recesses. It should also be apparent that a spacer with more than two levels can be preassembled and shipped to the construction site in a manner such as that described above.

The reinforcement spacer of the present invention provides excellent tolerances between the top and bottom reinforcement mats, between the surface of the concrete and the top of the reinforcement assembly and between the bottom of the bottom reinforcement layer and the bottom of the concrete. As noted above, the barb-type locking means lockably secures reinforcement members within the recesses. Therefore, as the concrete is poured around the reinforcement members and the spacers onto a horizontal surface, the reinforcement members cannot float out of the recesses due to the locking action of the barbs. Thus, the tolerances can be held within fairly narrow, desirable ranges. Narrow tolerance ranges are highly desirable because recent studies suggest that much corrosion of reinforcing steel in concrete structures is due to steel floating within the concrete as the concrete is being poured, frequently floating fairly close to the surface of the cover concrete where cracks will form or concrete will break away, creating areas where electrochemical corrosion reactions can occur on the reinforcement steel, especially werein deicing salt is used. This corrosion substantially weakens the structural integrity of the concrete structure and hastens its deterioration.

When the reinforcing steel is held within close tolerance to its designated position within the concrete structure, cracking of the concrete can be greatly reduced, minimizing the deterioration of the concrete and reinforcing steel.

The reinforcement spacer described above also prevents significant horizontal movement of reinforcement members before, during and after pouring of the concrete because the feet on the base of the reinforcement spacer of FIG. 1 or 4 or the bases on the spacers of FIGS. 4, 5 or 6 straddle a sufficient area whereby tipping of the reinforcement spacer is difficult. Because the barbs 14*b* can grip reinforcement members of sufficient diameter, horizontal movement of the reinforcement members within the barbed-recesses of the above embodiments is difficult.

Of course, it is understood that the above is merely a preferred embodiment of the invention and that various changes and alterations may be made without departing from the spirit and broader aspects of the invention.

The embodiments of the invention in which an exclusive property of privilege is claimed are defined as follows:

1. A reinforcement support spacer for use in spacing reinforcement members for concrete structures, said spacer comprising:

a support comprising at least two vertical webs joined together along one vertical edge of each web;

at least two recesses positioned in one of said webs for receiving reinforcement members therein; each of said recesses having opposed barbs therein for positively locking the reinforcement members into said recesses; and wherein a second of said webs is oriented transversely of the plane of said one web;

said one web is approximately the height of said support spacer and includes one of said recesses at the top thereof;

said second web is shorter than said support spacer and has a top surface defining a shoulder, whereby a first reinforcement rod or bar can be oriented in said one recess, and a second reinforcement rod or bar oriented transversely to and secured to said first reinforcement rod can be placed adjacent said support spacer, resting on or above said shoulder.

2. A reinforcement support spacer as recited in claim 1 wherein said locking means comprises a plurality of barbs projecting from said support into said recess and oriented in said recess to permit a reinforcement member to be forced past said barbs into said recess but substantially to prevent a reinforcement member from being forced past said barbs out of said recess once a reinforcement member has been inserted into said recess.

3. The reinforcement support spacer of claim 2 wherein said barbs slope generally downwardly into said recess.

4. A reinforcement support spacer as recited in claim 3 wherein said recess has a bottom portion in which a reinforcement member can be lockably received.

5. The reinforcement support spacer of claim 4 in which each said recess opens upwardly whereby reinforcement is inserted therein with a downward motion.

6. A reinforcement support spacer as recited in claim 5 which further includes a base plate on the bottom of said spacer.

7. A reinforcement support spacer of claim 6 wherein said base plate is removably secured to said support spacer.

8. The reinforcement support spacer of claim 7 wherein said base plate is eccentrically mounted on said support spacer.

9. The reinforcement support spacer of claim 8 wherein said base plate has at least one thickening rib extending underneath at lease one of said webs.

10. The reinforcement support spacer of claim 1 in which each said recess opens upwardly whereby reinforcement is inserted therein with a downward motion.

11. The reinforcement spacer of claim 1 wherein a third of said webs is oriented transversely of the plane of said second web and extends away from said one web, said third web having longitudinally oriented reinforcement means thereon.

12. The reinforcement spacer of claim 11 wherein said reinforcement means comprises at least one of a bead or a reinforcing rib extending longitudinally of and integrally formed with said third rib.

13. The reinforcement support spacer of claim 1 wherein said barbs slope generally downwardly into said recess.

14. A reinforcement support spacer for use in spacing reinforcement members for concrete structures, said spacer comprising:

four vertical webs joined together along one vertical edge of each web;

at least two recesses positioned in one of said webs for receiving reinforcement member therein;

each of said recesses having two pairs of opposed barbs therein projecting from said one web;

a second of said webs oriented transversely of the plane of said one web; and wherein:

said one web is approximately the height of said support spacer and includes one of said recesses at the top thereof;

said second web is shorter than said support spacer and has a top surface defining a shoulder, whereby a first reinforcement rod or bar can be oriented in said one recess and a second reinforcement rod or bar oriented transversely to and secured to said first can be placed adjacent said support spacer, resting on or about said shoulder.

15. The reinforcement support spacer of claim 14 in which each of said recesses opens upwardly, whereby reinforcement is inserted therein with a downward motion.

16. A reinforcement support spacer for use in spacing reinforcement members for concrete structures, said spacer comprising:

a support having at least one vertical web, and means for supporting said support in an upright generally vertical orientation; said web having an uppermost edge, and a side edge;

first and second recesses positioned in said web and shaped for receiving reinforcement members therein;

said first recess being positioned adjacent to the uppermost edge of said web;

said second recess being positioned in a medial portion of said web, and being oriented in a normally generally vertical direction;

a cutaway extending through the side edge of said web adjacent said medial web portion and communicating with said second recess whereby reinforcement is inserted therein with a downward motion.

17. The reinforcement support spacer of claim 16, wherein:

said first recess is positioned in the uppermost edge of said web, and opens upwardly, whereby reinforcement is inserted therein with a downward motion.

* * * * *